US006031500A

United States Patent [19]

Nagy et al.

[11] Patent Number: 6,031,500

[45] Date of Patent: Feb. 29, 2000

[54] BROADBAND FM VEHICLE REAR WINDOW ANTENNA NOT REQUIRING A BOOST AMPLIFIER

[75] Inventors: Louis Leonard Nagy, Warren; Janalee Ann Graham, Linden, both of Mich.

[73] Assignees: General Motors Corporation, Detroit; Delphi Technologies, Inc., Troy, both of Mich.

[21] Appl. No.: 09/287,215

[22] Filed: Apr. 1, 1999

[51] Int. Cl.[7] ..... H01Q 1/32

[52] U.S. Cl. ..... 343/713; 343/704; 428/210

[58] Field of Search ..... 343/704, 711, 343/712, 713; 428/34, 195, 210, 212; H01Q 1/32

[56] References Cited

U.S. PATENT DOCUMENTS

| | | | |
|---|---|---|---|
| 3,779,878 | 12/1973 | Swift et al. | 204/140 |
| 3,845,489 | 10/1974 | Sauer et al. | 343/713 |
| 4,791,426 | 12/1988 | Lindenmier et al. | 343/713 |
| 5,005,020 | 4/1991 | Ogawa et al. | 343/713 |
| 5,083,135 | 1/1992 | Nagy et al. | 343/713 |
| 5,334,988 | 8/1994 | Murakami et al. | 343/704 |
| 5,408,242 | 4/1995 | Nakase | 343/704 |
| 5,528,314 | 6/1996 | Nagy et al. | 343/713 |
| 5,557,289 | 9/1996 | Ohara | 343/713 |
| 5,581,264 | 12/1996 | Tabata et al. | 343/713 |
| 5,602,558 | 2/1997 | Urakami et al. | 343/850 |
| 5,610,619 | 3/1997 | Zafar | 343/713 |
| 5,629,711 | 5/1997 | Matsuoka et al. | 343/704 |
| 5,640,167 | 6/1997 | Hall | 33/713 |
| 5,641,558 | 6/1997 | Noda et al. | 428/210 |
| 5,646,637 | 7/1997 | Miller | 343/713 |
| 5,739,794 | 4/1998 | Nagy et al. | 343/713 |

*Primary Examiner*—Don Wong
*Assistant Examiner*—Tho Phan
*Attorney, Agent, or Firm*—George A. Grove; Robert M. Sigler

[57] ABSTRACT

A broadband FM antenna is suitable for mounting on an inner surface of a rear window glass of a motor vehicle above an electric rear window defogger grid also mounted on the glass and made of the same frit material. The antenna has an extended range of reception across a commercial FM band without the need for an antenna boost amplifier and is capable of use in multiple countries having different commercial FM bands. The antenna comprises a plurality of horizontal frit lines extending outward from a series of points near the horizontal center of the rear window as described and claimed herein. Some of these horizontal elements are joined by outer connecting frit lines at their outer ends and all are connected at their inner ends by a plurality of inner connecting elements connecting all of the points together. The frit lines essentially form a pair of horizontal antenna elements, each tuned to one quarter of a different commercial FM band wavelength so that the antenna spans the desired band or bands. A connecting pad of frit material on the window glass connected to two of the points provides an antenna connection.

1 Claim, 1 Drawing Sheet

BROADBAND FM VEHICLE REAR WINDOW ANTENNA NOT REQUIRING A BOOST AMPLIFIER

TECHNICAL FIELD

The technical field of this invention is vehicle antennas for FM radio reception.

BACKGROUND OF THE INVENTION

Most motor vehicles are provided with radios capable of reception of frequency modulated (FM) signals in a commercial frequency or wavelength band known as an FM band. Such FM antennas must be mounted on the vehicle in such a manner that they are not electromagnetically shielded by the vehicle body structure from the signals they are intended to receive, which generally requires the antenna to be externally mounted or incorporated in a vehicle window. The traditional "whip" antenna is well known but is also often considered undesirable for various well know reasons, including the possibility of breakage due to accident or vandalism, an unsightly appearance, etc. This has led to attempts to incorporate the FM antenna into the vehicle body in a more protected and less visible way.

One place for mounting of a vehicle FM antenna is on the rear window of the vehicle, which is also often the location of an electric rear window defogger grid. The presence of the defogger grid on the window is helpful in that the antenna may be made of the same electrically conducting frit material as the defogger grid and applied to the inner surface of the rear window along with the defogger at minor additional cost. But the defogger grid is also a problem in taking up a majority of the window area and thus leaving a small area for the antenna. The result is a non-optimal FM antenna design which tends to have a reception band that is too narrow to encompass the complete commercial FM band and thus requires a separate boost amplifier located as closely as possible to the antenna. Such an amplifier adds significant additional cost, which it would be desirable to eliminate.

In addition, different countries have defined different FM bands for use within their borders; and an FM antenna for a vehicle is generally tuned to the FM band of the country in which the vehicle is intended for sale. But in the modern international economy, vehicle manufacturers wish to design and build vehicles for sale in different countries with common components and thus desire a broadband FM antenna capable of encompassing as many of the different commercial FM bands as possible.

Many rear window antennas or suggestions for such antennas exist which attempt to meet all these objectives, either with or without the inclusion of the rear window defogger grid into the antenna, but few have met all the objectives simultaneously.

SUMMARY OF THE INVENTION

The antenna of this invention is thus a broadband FM antenna suitable for mounting on an inner surface of a rear window glass of a motor vehicle above an electric rear window defogger grid also mounted on the glass and made of the same frit material as the defogger grid. The antenna has an extended range of reception that eliminates the need for a separate antenna boost amplifier and also permits use in multiple countries having different commercial FM bands.

The antenna comprises a plurality of horizontal frit lines extending outward from a series of points near the horizontal center of the rear window as described and claimed herein. Some of these horizontal elements are joined by outer connecting frit lines at their outer ends and all are connected at their inner ends by a plurality of inner connecting elements connecting all of the points together. The frit lines essentially form a pair of horizontal antenna elements, each comprising a tuned element at one quarter of a different commercial FM band wavelength so that the antenna spans both bands. A connecting pad of frit material on the window glass connected to two of the points provides an antenna connection.

DESCRIPTION OF THE PREFERRED EMBODIMENT

Figure 1:
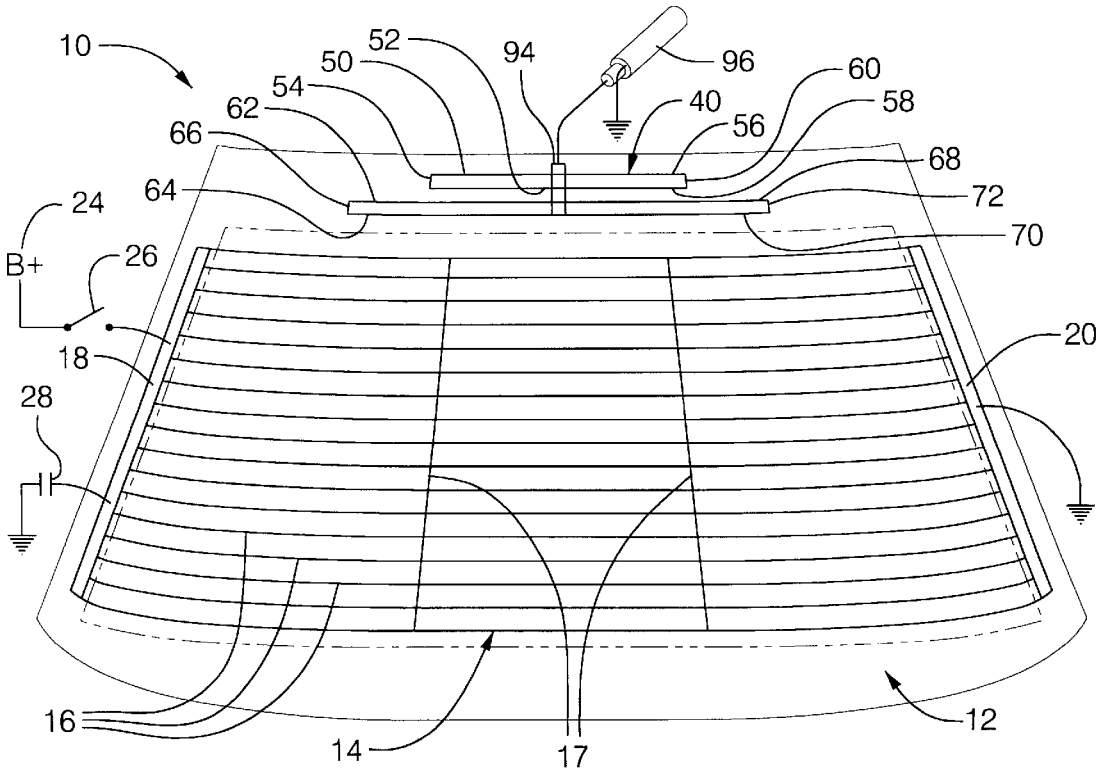
FIG. 1 shows a preferred embodiment of an antenna according to the invention sharing the rear window of a motor vehicle with an electric defogger grid.

Referring to FIG. 1, a vehicle body 10, made typically of an electrically conducting metal such as steel or aluminum, has a rear window opening in which a window glass 12 is mounted in the normal manner. A defogger grid 14 is formed on the surface of glass 12 within the passenger compartment of vehicle body 10. Defogger grid 14 is made of a standard, electrically conducting frit material and applied to the window glass in the normal manner. Defogger grid 14 comprises a plurality of thin, parallel, horizontal conducting, heating elements 16 each extending across the rear window from a vertical connecting bus 18 on the left in the figure to a vertical connecting bus 20 on the right in the figure. Vertical elements 17 may connect the horizontal elements as shown. Connecting buses 18 and 20 are typically made wider for lower resistance in current distribution to the higher resistance heating elements 16. Connecting bus 18 is connected to a direct current (DC) source 24 through an energizing switch 26; and the left connecting bus 20 is provided with a ground return to DC source 24. DC current source 24 is typically the vehicle battery and alternator system; and closure of switch 26 allows DC current flow from source 24 through heating elements 16. Connecting bus 18, at the high voltage side of defogger grid 14, is grounded capacitively at FM frequencies to vehicle body 10, as indicated by capacitor 28. This may be accomplished by positioning connecting bus 18 to be in contact with a standard urethane bead, not shown, which supports window glass 12 in the window opening, the urethane bead having a high resistance at DC but a low resistance at FM frequencies due to a characteristic high dielectric constant. The grounding at FM frequencies prevents defogger grid 14 from significantly affecting the FM performance of the antenna sharing rear window glass 12.

Antenna 40 of this invention is made of the same electrically conducting frit material as defogger grid 14 and is applied to the inner surface of rear window glass 12 in the same process at the same time as the application of defogger grid 14. Antenna 40 is confined to a small upper region of window glass 12 and is not physically connected or electrically coupled to defogger grid 14. The antenna is made of a connected plurality of frit lines, where the phrase "frit line" is used to designate a very thin, extended element of frit material as is commonly used to construct defogger grids. The actual thickness of the lines will be determined by the antenna designer to satisfy the requirements of a specified antenna impedance and a desire for minimal visual obstruction or detraction.

The antenna essentially comprises two parallel, horizontal elements, each tuned to a different commercial FM wavelength. The wavelengths may be chosen from the same commercial FM band if the best possible reception for that band is required or may be chosen from two distinct commercial FM bands to provide broadband reception across both bands. The latter is possible because the commercial FM bands in most countries, if not the same, are adjacent and/or overlapping in wavelength. For example, the commercial FM band in the United States covers a frequency band of approximately 88 to 108 MHz and the commercial FM band throughout most of Europe is the same. Thus, tuning of the elements to approximately 90 and 104 MHz will provide an antenna optimized for the United States and Europe without requiring a separate boost amplifier. The commercial FM band in Japan is approximately 76 to 90 MHz, which is lower but somewhat overlaps the commercial FM band in the United States and Europe. If the elements are tuned to somewhat lower frequencies, for example, 84 and 100 MHz, with one frequency in each of the bands, the reception band may be extended essentially across the entire combined range of 76 to 108 MHz.

Figure 2:
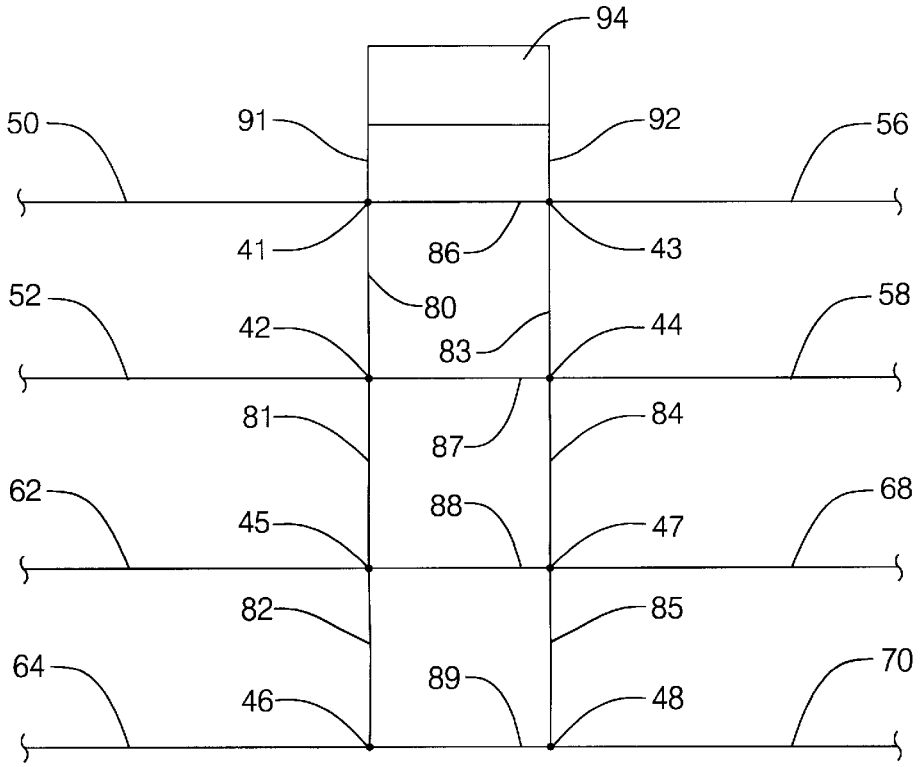
FIG. 2 shows an enlarged view of a portion of the antenna of FIG. 1.

Referring to FIG. 1 and 2, antenna 40 comprises a horizontal frit line 50 extending to the left from a point 41 and a horizontal frit line 52 extending to the left from a point 42, with horizontal frit lines 50 and 52 joined at their outer ends (the left in the figure) by an outer connecting frit line 54, which is preferably essentially vertical. Points 41 and 42 are vertically aligned just to the left of the horizontal center of window glass 12 and vertically separated by about 4.45 cm (1.75 inches). In addition, a horizontal frit line 56 extends to the right from a point 43 and a horizontal frit line 58 extends to the right from a point 44 and is joined at its outer end (the right in the figure) to horizontal frit line 56 by an outer connecting frit line 60. Points 43 and 44 are vertically aligned just to the right of the horizontal center of window glass 12 and are horizontally aligned with points 41 and 42, respectively, and separated therefrom horizontally by about 2.54 cm (1 inch). Each of horizontal frit lines 50, 52, 56 and 58 has a length of about 29.21 cm (11.5 inches).

Antenna 40 further comprises a horizontal frit line 62 extending to the left from a point 45 and a horizontal frit line 64 extending to the left from a point 46, with horizontal frit lines 62 and 64 joined at their outer ends (the left in the figure) by an outer connecting frit line 66, which is preferably essentially vertical. Points 45 and 46 are vertically aligned just to the left of the horizontal center of window glass 12, with each other and vertically separated by about 3.8 cm (1.5 inches). Points 45 and 46 are also vertically aligned with and below points 41 and 42, with points 42 and 45 being vertically separated by about 3.18 cm (1.25 inches). In addition, a horizontal frit line 68 extends to the right from a point 47, and a horizontal frit line 70 extends to the right from a point 48 and is joined at its outer end (the right in the figure) to horizontal frit line 68 by a connecting frit line 72. Points 47 and 48 are vertically aligned just to the right of the horizontal center of window glass 12, with each other and with points 43 and 44, and are horizontally aligned with points 45 and 46, respectively. Each of horizontal frit lines 62, 64, 68 and 70 has a length of about 42 cm (16.5 inches).

In the embodiment shown, each of the points 41–48 is joined to its horizontal and vertical neighbors by inner frit lines, which are identified in FIG. 2, an enlargement of the relevant portion of antenna 40. Inner connecting member 80 connects points 41 and 42. Inner connecting frit line 81 connects points 42 and 45. Inner connecting frit line 82 connects points 45 and 46. Inner connecting frit line 83 connects points 43 and 44. Inner connecting frit line 84 connects points 44 and 47. Inner connecting frit line 85 connects points 47 and 48. Inner connecting frit line 86 connects points 41 and 43. Inner connecting member 87 connects points 42 and 44. Inner connecting frit line 88 connects points 45 and 47. Inner connecting frit line 89 connects points 46 and 48.

The antenna described above is designed to be for the 88–108 MHz commercial FM bands of the United States and Europe. Thus, horizontal frit lines 52 and 58, together with inner connecting frit line 87 comprise a horizontal tuned antenna element with a total physical length of about 61 cm (24 inches). The same is true of frit lines 50, 86 and 56. These elements are effectively tuned to a commercial FM frequency of 104 MHz. Horizontal frit lines 64 and 70, together with inner connecting frit line 89, comprise a horizontal tuned antenna element with a total physical length of 86.4 cm (34 inches). The same is true of frit lines 62, 88 and 68. These elements are effectively tuned to a commercial FM frequency of 88 MHz. The coverage band may be extended to include the Japanese commercial FM band by lengthening the horizontal frit lines.

In this preferred embodiment, which uses ten inner connecting frit lines 80–89, the points are connected together with the overall lowest resistance therebetween, due to multiple current paths between the points and a maximum of four inner connecting frit lines in series between any two of the points. But not all the inner connecting frit lines are absolutely required. The minimum requirement is that none of the points 41–47 is left unconnected from the others. The omission of certain inner connecting frit lines may impact the antenna design in other areas. For example, inner connecting frit line 87 directly connects points 42 and 44 and thus provides the shortest possible added length to horizontal frit lines 52 and 58, for a total length of effectively one quarter of a predetermined wavelength. If this inner connecting frit line is omitted, a larger number of inner connecting frit lines will be required to connect points 42 and 44, and the length of horizontal frit lines 52 and 58 may have to be shortened to maintain the tuning to the predetermined wavelength. The same consideration applies to inner connecting frit line 89 with respect to the other predetermined wavelength. Other alternate embodiments using different subsets of the ten inner connecting lines 80–89 will be readily apparent to those of ordinary skill in the art of antenna design.

A connecting pad 94 may be provided on window glass 12 above antenna 40 and connected directly to points 41 and 43 thereof or connected thereto as shown by pad connecting frit lines 91 and 92, respectively. The inner conductor of a co-axial antenna feed cable 96 is attached to connecting pad 94, with the shield conductor grounded to the vehicle body. Antenna 40 described herein is designed with a characteristic impedance of 125 ohms, to be ideally matched to a feed cable 96 of the same characteristic impedance and a radio at the other end of feed cable 96 having an input impedance that is also 125 ohms. The impedance matching at 125 ohms is believed to increase the performance of this antenna over those having lower characteristic impedances. Window glass 12 may be provided with an outer dark shaded or tinted area defined by dashed line 98 in FIG. 1; and antenna 40 may be placed in whole or in part within this area.

We claim:

1. A broadband FM antenna suitable for mounting on an inner surface of a rear window glass of a motor vehicle above an electric rear window defogger grid also mounted on the glass, the antenna and defogger grid comprising a common frit material, the antenna comprising, in combination:

first and second horizontal frit lines extending parallel to each other in a first direction from first and second points, respectively, near the horizontal center of the window, the first and second points being vertically aligned on the window glass, the first and second frit lines being connected by a first outer connecting frit line at their ends opposite the first and second points;

third and fourth horizontal frit lines extending parallel to each other in a second direction, opposite the first direction, from third and fourth points, respectively, near the horizontal center of the window, the third and fourth points being vertically aligned on the window glass and horizontally aligned with the first and second points, respectively, the third and fourth frit lines being connected by a second outer connecting frit line at their ends opposite the third and fourth points;

fifth and sixth horizontal frit lines extending parallel to each other in the first direction from fifth and sixth points, respectively, near the horizontal center of the window, the fifth and sixth points being vertically aligned on the window glass below and in vertical alignment with the first and second points, the fifth and sixth frit lines being connected by a third outer connecting frit line at their ends opposite the fifth and sixth points;

seventh and eighth horizontal frit lines extending parallel to each other in the second direction from seventh and eighth points, respectively, near the horizontal center of the window, the seventh and eighth points being vertically aligned on the window glass below and in vertical alignment with the third and fourth points and horizontally aligned with the fifth and sixth points, respectively, the seventh and eighth frit lines being connected by a fourth outer connecting frit line at their ends opposite the seventh and eighth points;

a plurality of inner connecting frit lines connecting the first, second, third, fourth, fifth, sixth, seventh and eighth points together so that the total connected length of the second horizontal frit line, the fourth horizontal frit line and those of the connecting frit lines providing the shortest connecting path therebetween effectively comprises a tuned element at one quarter of a first commercial FM band wavelength and also so that the total connected length of the sixth horizontal frit line, the eighth horizontal frit line and those of the connecting frit lines providing the shortest connecting path therebetween effectively comprises a tuned element at one quarter of a second commercial FM band wavelength, the first and second commercial FM band wavelengths providing broadband coverage across both a commercial FM band without requiring an antenna boost amplifier; and a connecting pad of frit material on the window glass connected to the first and third points.

* * * * *